US009414695B2

(12) United States Patent
Steber et al.

(10) Patent No.: US 9,414,695 B2
(45) Date of Patent: Aug. 16, 2016

(54) RING HOLDER, SYSTEM COMPRISING A RING HOLDER AND A RING DISPLAY AND METHOD FOR CONNECTING A RING TO A RING HOLDER

(71) Applicant: Beeline GmbH, Köln (DE)

(72) Inventors: Harald Steber, Essen (DE); Meike Noster, Essen (DE); Marcus Frankowski, Essen (DE)

(73) Assignee: BEELINE GMBH, Cologne (DE)

( * ) Notice: Subject to any disclaimer, the term of this patent is extended or adjusted under 35 U.S.C. 154(b) by 0 days.

(21) Appl. No.: 14/354,519

(22) PCT Filed: Oct. 25, 2012

(86) PCT No.: PCT/EP2012/071171

§ 371 (c)(1),
(2) Date: May 13, 2014

(87) PCT Pub. No.: WO2013/060785

PCT Pub. Date: May 2, 2013

(65) Prior Publication Data

US 2014/0306073 A1 Oct. 16, 2014

(30) Foreign Application Priority Data

Oct. 27, 2011 (EP) ..... 11186905

(51) Int. Cl.
*A47F 7/02* (2006.01)
*A47F 7/024* (2006.01)
*A47F 5/16* (2006.01)

(52) U.S. Cl.
CPC . *A47F 7/024* (2013.01); *A47F 7/02* (2013.01); *A47F 2005/165* (2013.01)

(58) Field of Classification Search
CPC ..... A47F 5/16; A47F 7/02; A47F 7/024
USPC ..... 211/85.2; 206/6.1, 488, 564, 565, 566
See application file for complete search history.

(56) References Cited

U.S. PATENT DOCUMENTS 672,561 A * 4/1901 Loeb ..... A47F 7/024 206/560
3,289,853 A * 12/1966 Eichhorn ..... A47F 7/02 211/85.2

(Continued)

FOREIGN PATENT DOCUMENTS

CH 342 075 A 10/1959
DE 20 10 130 10/1978

(Continued)

*Primary Examiner* — Michael Safavi
(74) *Attorney, Agent, or Firm* — Richard M. Klein; Fay Sharpe LLP

(57) ABSTRACT

The invention relates to a ring holder (10), a ring display (36) comprising such a ring holder (10), and a method for connecting a ring (30) to a ring holder (10). The invention particularly addresses the problem of providing a device and a method for the presentation of rings (30), said device and method allowing a permanently attractive presentation of rings. A ring holder (10) according to the invention comprises a flat gripping section (12), at least one contact surface (14), arranged perpendicular to the gripping surface (12) and adjoining the gripping surface (12), for arranging the outer side of a ring (30) as an extension of the gripping section (12), and at least one fixation element (16) that is arranged at a distance from the contact surface (14) and perpendicular to the gripping section (12) and makes it possible to immobilize a ring relative to the contact surface (14) by using a strip-like holding means.

12 Claims, 3 Drawing Sheets

(56) References Cited

U.S. PATENT DOCUMENTS

| | | | | |
|---|---|---|---|---|
| 3,645,403 | A * | 2/1972 | Walters | A47F 7/02 211/85.2 |
| 5,600,937 | A | 2/1997 | Erickson et al. | |
| D379,100 | S | 5/1997 | McAuley et al. | |
| 5,720,498 | A | 2/1998 | McAuley et al. | |
| 6,006,899 | A | 12/1999 | McAuley et al. | |
| 7,714,721 | B1 | 5/2010 | Feibelman et al. | |
| 2012/0234057 | A1* | 9/2012 | Feibelman | G09F 3/037 70/58 |

FOREIGN PATENT DOCUMENTS

| | | | | |
|---|---|---|---|---|
| DE | 88 00 666 | U1 | 5/1988 | |
| DE | 93 12 889 | U1 | 3/1994 | |
| DE | 44 11 056 | A1 | 10/1995 | |
| DE | 296 19 248 | U1 | 2/1997 | |
| DE | 197 06 294 | B4 | 10/1997 | |
| DE | 198 39 055 | C2 | 6/2001 | |
| EP | 1 031 305 | A2 | 8/2000 | |
| WO | WO 8604796 | A1 * | 8/1986 | A47F 7/024 |

* cited by examiner

RING HOLDER, SYSTEM COMPRISING A RING HOLDER AND A RING DISPLAY AND METHOD FOR CONNECTING A RING TO A RING HOLDER

The invention relates to a ring holder, a system comprising a ring display with such a ring holder, as well as a method for connecting a ring to a ring holder.

DE 44 11 056 C2, DE 93 12 889 U1, DE 296 19 248 U1, DE 197 06 294 B4 and DE 198 39 055 C2 disclose different ring displays all of which share the feature that the ring is connected to a weight that is disposed below a presentation plate and that causes the ring to be pulled into a funnel-like receptacle trough. The ring can be pulled out of this funnel-like receptacle trough for the purpose of viewing it and trying it on. In this case, the counterweight moves upward, together with the ring. Rings that are accommodated in these displays are fastened to a simple string that is guided around the ring, knotted to the ring, and fastened, by the other end, to the counterweight. The afore-described easy attachment modality for the ring by the use of a string has the disadvantage that the ring is able to move relative to the thread; particularly, it can rotate out of place. This means that the sales personnel must intermittently realign rings with affixed applications inside the ring display to ensure that rings with applications are properly positioned inside the ring display. Further, the sales personnel must tie each ring individually to the string, which is a very time-consuming undertaking.

DE 20 10 130 C3 discloses a ring holder for presenting finger rings, where the rings are immobilized by a so-called "clamping beak." This ring holder provides only a force closure for holding the ring in place. It is disadvantageous therein that the ring must be removed from the ring holder, when it is to be tried on.

DE 88 00 666 U1 describes a so-called display panel that can be used as a ring holder. The display panel has a "3-tongue stamping" modality by which rings, bracelets and other jewelry pieces are safely fastened to a display panel, while still intentionally preserving the possibility that the customer can try on individual pieces. However, particularly for valuable rings, such display panels are not used; the disclosed display panel is a typical disposable item that creates the subjective impression of cheapness and low value of the associated rings and items that are displayed on it.

It is therefore the object of the present invention to provide a device and a method for presenting rings that does not suffer from the disadvantages as described above and to thereby provide an option for a permanently appealing ring presentation.

The task is achieved by a ring holder that has the characteristics as specified in claim 1, a system comprising a ring display and ring holder having the characteristics of claim 13 and/or a method for connecting a ring to a ring holder as specified in claim 14.

A ring holder according to the invention comprises a flat gripping section, at least one contact surface that is arranged transverse relative to the gripping section and adjoining the gripping section for disposing the outer side of a ring as an extension of the gripping section, as well as at least one fixation element that is disposed at a distance from the contact surface and transverse relative to the gripping section and that allows for immobilizing a ring relative to the contact surface by using a strip-like holding means. A contact surface is understood as any surface that forms at least one flat support area for a ring, for example a flat contact section, upon which the ring rests, by a strip-like area, against the outer circumference on the contact surface. A gripping section is understood, in particular, as an area on the ring holder that can be enclosed by at least two fingers. The ring holder according to the invention has the advantage that a ring is immobilized by the use of a holding means relative to the contact surface such that the relative orientation with regard to the ring holder is preserved, also against the impact of outside forces (for example, due to multiple customers trying on the ring). Moreover, a ring that is immobilized on a ring holder according to the invention is optically almost completely visible, despite it being fastened to the ring holder, because, only in the area of the contact surface, there is a small area on the outer side of the ring that is covered up by the ring holder. A further advantage of the ring holder according to the invention is the fact that customers can try on the ring, which is immobilized on the ring holder.

Suitable fixation elements are, in particular, through-holes and/or side arms that are disposed transverse relative to the direction of extension of the gripping section. They allow specifically for an easy and, in particular, fixed connection of a ring with the contact surface in that a holding means (for example, a string, band, wire or other kind of holding means) is guided around the ring as tightly as possible, then guided through the through-hole(s) and/or around the ring and/or around the side arm, and then immobilized in the position thereof. The fixation of the position of the holding means can be achieved, in particular, by connecting the two ends or by immobilizing the respective ends relative to the ring holder.

The through-holes in the areas where holding means are present are preferably designed as curved, preferably circularly arched or circularly rounded. It is further preferred for them to include radii in all areas where holding means extend to avoid damage to holding elements due to sharp edges. The same applies correspondingly for the side arms.

The connection between ring and ring holder can be further improved by providing a depression on at least one side arm that is disposed as transverse relative to the direction of extension of the gripping section and intended for accommodating a holding means. By providing a depression, it is possible to define not only the position of the holding means; moreover, it is possible to reduce the risk of holding means that become overstretched over time from coming loose, or stretched-out retaining loops from coming loose from the ring holder.

The contact surface is preferably configured as curved. This increases the area along which the ring is enclosed by the contact surface. This in turn allows for the possibility of selecting a wider spacing between individual holding areas, thereby improving the connection.

For the same reason, according to a further practical embodiment, it is preferred to dispose three fixation elements at a distance relative to each other in the transverse direction. Preferably, the fixation elements are positioned such that the holding means can be guided around a ring, which is disposed on the contact surface, such that the holding areas that result from the enclosure of the ring by the holding means are disposed at a maximally large distance relative to each other with regard to the contact surface.

In a further practical embodiment, a central through-hole is provided as a first fixation element. Moreover, second, third, fourth and fifth fixation elements are configured to the right and to the left next to the through-hole and on both sides of the gripping element of the side arm.

Particularly robust side arms are obtained in this case, when the side arms that are disposed adjacently to the right and to the left of the through-hole have a width of 10% to 50%, preferably 30% to 45% of the width of the gripping element.

The gripping section preferably has a plunging area of an even thickness on the side that is opposite the contact surface and borders on an at least partially flat stop element. The ensuing advantage is that the ring holder according to the invention can be plugged into a ring display with an opening that is configured as a slot and a preferably also flat, adjacent surface. In fact, in this case, the ring holder will always align itself relative to the ring display such that the two flat surfaces come to rest against each other.

The stop element is preferably constituted by one, preferably all, side arms, particularly such that, this way, it is possible to save material that would otherwise be needed for creating a separate stop element. For the same reason, it is preferred for the contact surface to be constituted, at least in part, of one or a plurality of lateral surfaces of one or a plurality of side arms.

A particularly simple and cost-effective production of the ring holder according to the invention is achieved, when the ring holder is configured in one piece. In this case, the ring holder can be manufactured, for example, by way of a plastic injection molding process, such as, for example, made of polypropylene (PP).

It is also advantageous to provide a constriction in the area above the through-hole. This way, it is possible to ensure that a holding means, which is guided from the through-hole upward and around the rings that are to be immobilized, particularly narrow rings, laterally grips the respective ring already with the upward motion, not, for example, the side wall of a contact surface that would be gripped, if the ring holder were wider at this point than the ring itself.

Further technical characteristics of the ring holder according to the invention will be described below, which can be combined with all combinations of characterizing features as specified in the claims:

- The gripping section and at least two side arms have a T-shaped cross-section at least in a longitudinal sectional plane of the ring holder.
- The ring holder is preferably designed as mirror-symmetrical.
- Depressions can be configured on the gripping section for accommodating labels or other elements.
- The gripping section can have printed thereon or affixed thereto such information as a barcode, a price and details regarding the manufacturer, etc.

Most commercially available rings have a diameter of between 10 mm and 25 mm. The width of the ring holder according to the invention is preferably between 10 mm and 50 mm, particularly preferred between 15 mm and 30 mm.

A ring holder according to the invention can be particularly preferably used with a ring display that is especially matched for use together with the same. Therefore, protection is independently claimed also for a system that is comprised of a ring holder and ring display having the characteristics as specified below:

- The ring display includes a plate with at least one opening that is configured as a slot, and the slot width is matched to the thickness of the gripping section of the ring holder such that the gripping section can be inserted in the slot for the purpose of presenting a ring that is immobilized on the ring holder; and
- A stop element is disposed on the ring display and/or the ring holder that limits the insertion depth of the ring holder inside the slot.

Correspondingly, a distinction is possible; in particular, it is possible to distinguish between a first variant, where the insertion depth is limited by a stop element that is disposed on the ring holder, and a second variant, where the insertion depth is limited by a stop element that is provided on the ring display. The latter is preferably achieved in that the depth of the slot is selected as shorter than the length of the ring holder. The insertion depth is then limited by the ring holder making contact with the floor of the ring display.

The system according to the invention comprising a ring display and ring holder has the advantage that, for an attractive presentation of rings, for example on the sales floor, it is only necessary to insert the ring holder into the openings, which are configured as slots, of a ring display provided for this purpose. The applies, in particular, when the slots are disposed and dimensioned such that the ring holders can only be inserted in the direction of the gravitational force, or at least at an angle between 0° and 45° relative to the normal of the slots. Gravitation then causes the unit comprising ring holder and ring to move by itself to the maximum insertion depth, once the ring holder has been inserted into the opening that is configured as a slot, provided sufficient play exists between the ring holder and the walls that delimit the slot.

When, according to a first variant, a separate opening, which is configured as a slot, is designed for each ring holder in a ring display (preferably with a complementary contact area), the insertion angle of a ring holder that is completely inserted into the opening, which is configured as a slot, and of a ring that is connected thereto can be preset. According to a first variant, this is achieved in that the side of the gripping section that is disposed opposite the contact surface is configured with a certain contour (for example, as semi-rounded), and the floor of the ring display in the floor area of a slot is configured as complimentary.

According to a second variant, a stop element that is disposed on the ring holder and laterally extending can have a flat contact surface that comes to rest against another, also flat contact area that adjoins the opening, which is configured as a slot.

The last described second variant has the advantage that ring displays with long, continuous openings, which are configured as slots, can be used, always allowing for an attractive arrangement within the ring display, independently of the number of units of rings and ring holders disposed therein. In fact, in this case, it is possible to push the ring holders together without much effort, such that no "product gaps" between items are visible within the ring display; this is a problem that cannot be avoided on ring holders with individual slots. This applies independently of how wide the ring holders are together with the rings.

A further advantage of the system according to the invention is that the rings, together with the ring holders, can already be pre-finished at the point of manufacturing and optimally prepared for the use at the point of sale. The complexity that is involved in an attractive presentation on the sales floor can therefore be limited to simply incorporating the pre-finished units of rings and ring holders into the already existing ring displays. In particular, it is not necessary to label individual items by hand, or even connect them to elements of ring displays at the point of sale.

The invention also relates to a method for connecting a ring to a ring holder, particularly to a ring holder according to the invention, including the following method steps:

a) Positioning the ring on a curved contact surface;
b) Fixing the relative position of the ring on the contact surface of the ring holder with at least one strip-like fixation element relative to two areas of the contact surface that are spaced at a distance relative to each other, preferably in the outer areas of the curved contact surface;

c) Optionally additional fixation of the ring with a fixation element relative to a third area that is spaced at a distance relative to the previously mentioned areas.

The method according to the invention has the advantage that a ring can be connected simply and cost-effectively to a ring holder. This applies, in particular, when the ring holder is designed such that the ring can be immobilized on the contact surface with the aid of a holding means that is configured as a closed ring (for example, a band made of rubber, silicon, and the like) relative to the ring holder. This connecting modality will be addressed in further detail in the description of the figures below.

The above-referenced areas are preferably selected such that they are spaced at distances as far apart from each other as possible.

In a further practical embodiment, the ring is immobilized by at least one elastic holding element relative to two areas that are spaced at a distance relative to each other of the contact surface such that the holding element causes a reset force to be generated in the presence of relative movement relative to the fixation position.

Further practical embodiments and advantages of the invention will be described below based on the drawings. These show the following:

FIGS. 1*a*-1*f* are representations of a first embodiment of a ring holder according to the invention, seen in different perspective views;

FIGS. 2*a-d* are representations of the ring holder as shown in FIG. 1, together with a ring and holding means, seen in different arrangements and varying perspective views;

Figures 1A, 1B, 1C, 1D, 1E, 1F:
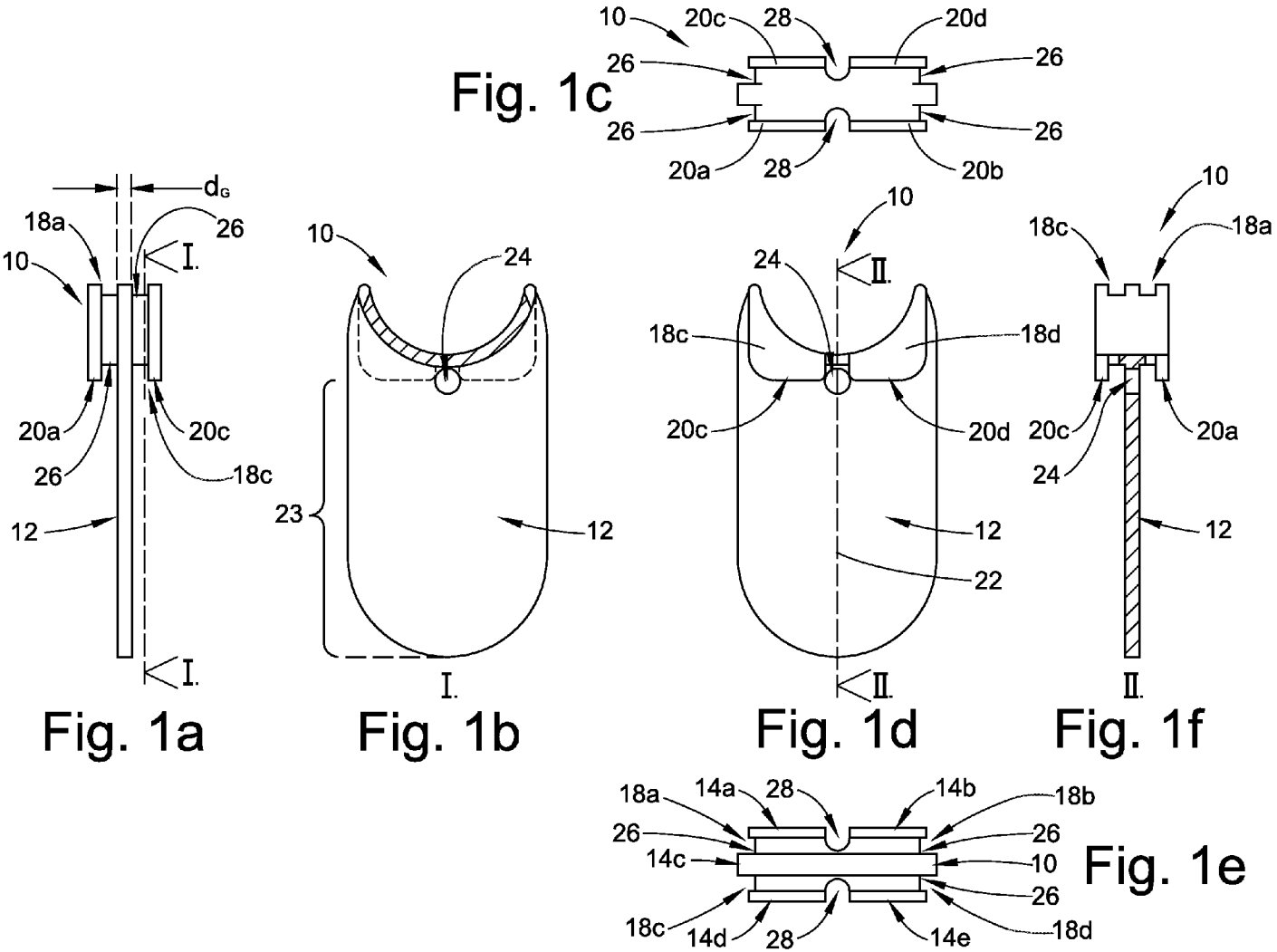
FIG. 1 shows a ring holder 10 according to the invention in a side view (FIG. 1*a*), a sectional view according to arrows I in FIG. 1*a*, a bottom view (FIG. 1*e*), a top view (FIG. 1*c*), a front view (FIG. 1*d*), and a section view according to arrows II in FIG. 1*d*.

The ring holder 10 comprises a flat gripping section 12, a contact surface 14 that is arranged transverse relative to the gripping section 12 adjoining the gripping section 12 for disposing the outer side of a ring thereon as an extension of the gripping section 12, as well as five fixation elements that are arranged at a distance from the contact surface 14 and transverse to the gripping section 12 allowing for immobilizing a ring relative to the contact surface 14 with the use of strip-like holding means. It can be discerned that the contact surface 14 is configured as circularly arched to provide a maximum contact area for the ring that must be immobilized. The radius of this contact surface is preferably matched to the outer radius of a commonly commercially available finger ring that must be immobilized with this device.

The gripping section 12 is constituted of a plate-like element of even thickness of ca. 3 mm. In the top area of the gripping section 12, the fixation elements are configured as four side arms 18*a*, 18*b*, 18*c*, 18*d* that laterally protrude relative to the gripping section 12. Flat stop elements 20*a-d* are formed on the underside of the side arms 18*a-d*. These comprise areas that are aligned transversely relative to a center axis 22. The design, as previously described, allows for inserting the ring holder 10 into a slot-like opening of a slot width of at least 3 mm, and/or for letting the same slide into the slot, when the slot width is greater. The stop elements 20*a-d* that are formed on the side arms 18*a-d* then jointly constitute a stop that prevents a ring holder 10, which has been pushed into the slot over the total plunging area 23, from plunging still further into the slot.

As can be seen particularly in FIGS. 1*a*, 1*c* and 1*f*, the top side surfaces of the side arms 18*a-d* form, jointly with the top lateral area of the gripping section 12, the contact surface 14.

The gripping section 12 further accommodates a through-hole 24 on the center axis 22 as a further fixation element.

As can be discerned, in particular, in FIGS. 1*a*, 1*c*, 1*e* and 1*f*, partial circumferential depressions 26 (laterally and below) are configured on the side arms 18*a-d* adjacently to the gripping section. These depressions serve as guide means for a silicone string, a rubber band or other holding means, as well as for protecting the same against mechanical impact.

In the area above the through-hole 24, the ring holder 10 includes on both sides constrictions 28. The thickness of the ring holder 10 in the area of the constrictions is 3.5 mm to 4 mm in the shown embodiment. It is understood that the thickness can be reduced, when rings of a width of less than 3.5 mm are to be connected to the ring holder.

Aside from the ring holder 10 according to the invention, as shown in the first embodiment, FIGS. 2*a-d* present two silicone strings serving as holding means 32*a*, 32*b* and a finger ring 30.

Figure 2A:
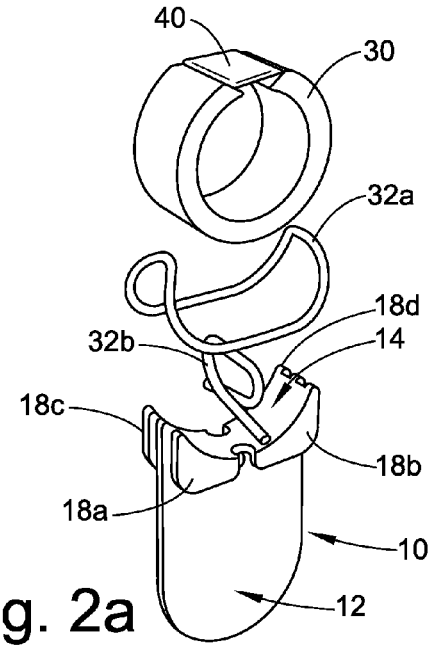
Figure 2B:
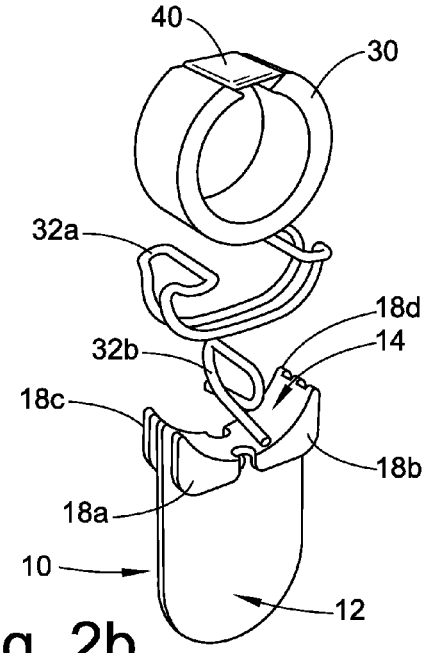

FIG. 2*a* shows the previously mentioned elements individually by way of an exploded view. FIG. 2*b* differs from FIG. 2*a* only in that the form of the holding means 32 is depicted in such a manner so as to demonstrate the position of the silicone string, when it encloses the ring 30 for the purpose of immobilizing the ring 30 relative to the ring holder 10.

The FIGS. 2*a-d* show how a finger ring 30 with an application 40 (here: a stone) can be easily connected to a ring holder 10.

Figure 2C:
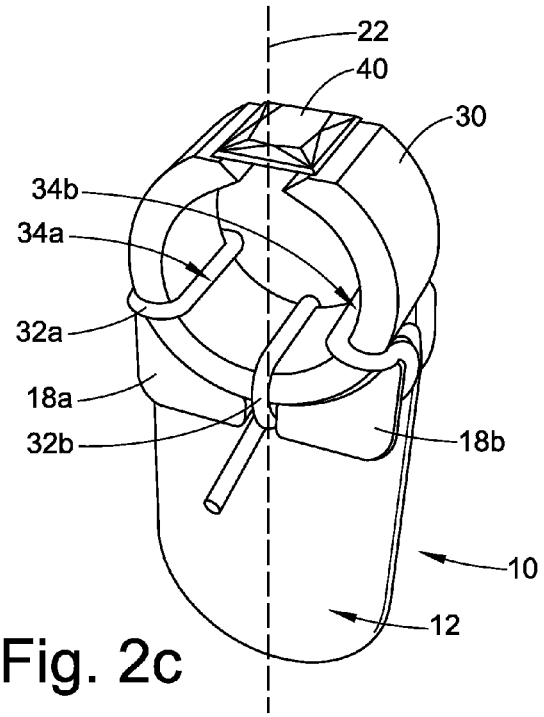
Figure 2D:
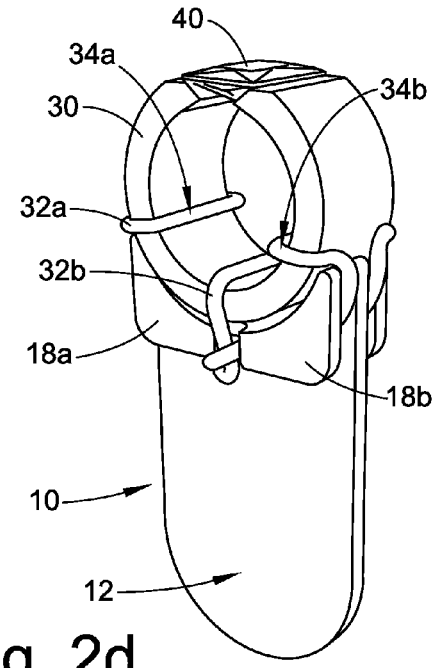

To this end, the outer side of the ring 30, as shown in FIGS. 2*c* and 2*d*, is brought into contact with the contact surface 14. In a further step, the holding means 32*a*, preferably a string made of silicone or rubber, is inserted in the bottom and lateral depressions 26 of the side arms on one side, for example side arms 18*a*, 18*b*, and thereby anchored on one side. The holding means 32*a* is then guided upward and guided through over the inner side of the ring 30, which rests against the contact surface 14 of the ring holder 10. By bracing and inserting and/or anchoring the holding means 32*a* in the lateral and bottom depressions of the side arm 18*c*, 18*d* on the other side of the ring holder 10, the ring 30 is finally immobilized on the contact surface 14 in both holding areas 34*a*, 34*b*.

The use of elastic holding means 32*a*, 32*b*, particularly the use of holding means that have together with the ring 30 a coefficient of friction above 0.5 has the advantage that there exists a cohesive friction between the holding means and the ring 30 that is quite high, whereby outer forces are countered by a reset force until the cohesive friction is overcome, due to the resilient effect of the holding means 32*a*, 32*b*, returning the ring 30 in the original position if it was shifted or rotated out of position.

The connection between the ring holder 10 and the ring 30 can be further improved when, as shown in the FIGS. 2*c* and 2*d*, a further holding means is disposed around the ring, passing though the through hole 24 in the area of the center axis 22 and braced thereto, for example, by a simple knot.

Figure 3:
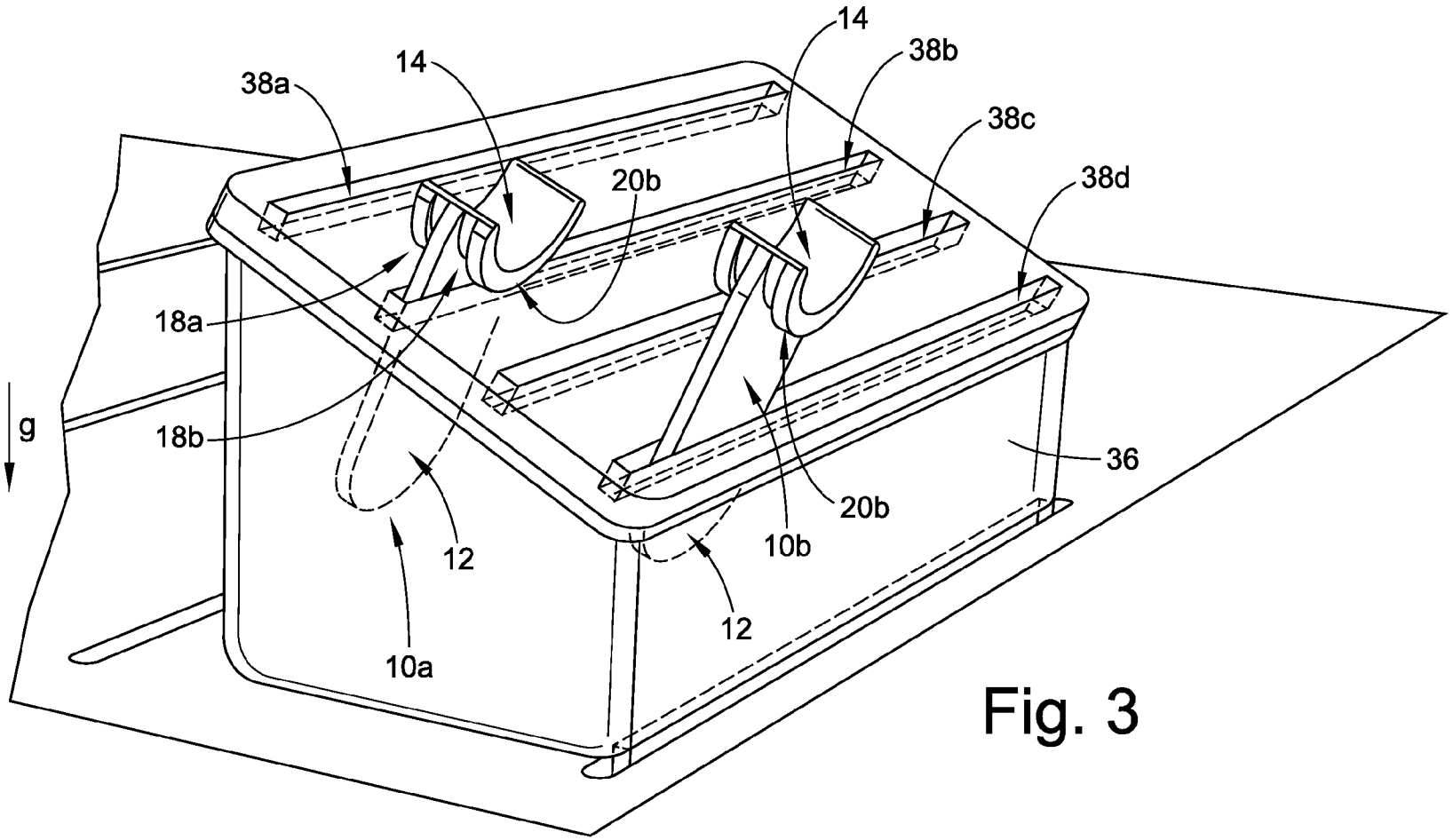
FIG. 3 is a representation of a system according to the invention comprising a ring display and a ring holder according to a second embodiment, seen in a perspective view.

FIG. 3 shows a second embodiment of a ring holder according to the invention. The same reference signs have been used below for those elements of the ring holder 10 according to this embodiment that are identical with elements from the first embodiment or that correspond to these from a functional aspect, as set forth in the description of the first embodiment.

FIG. 3 depicts, aside from the second embodiment, a system according to the invention comprising a ring display 36 and two ring holders 10 according to the second embodiment.

The ring holders 10 according to the second embodiment each comprise a flat gripping section 12, a contact surface 14 that is arranged transverse relative to the respective gripping section 12 and adjoining the gripping section for arranging the outer side of a ring 30 as an extension of the gripping section 12. Moreover, two fixation elements are provided transverse to the gripping section 12 that allow for immobilizing the ring by the use of a strip-like holding means relative to the respective contact surface 14. It can be discerned that the contact surface 14 is configured as circularly arched to provide a maximum contact area for the ring 30 that must be immobilized. The radius of the contact surface is preferably matched to the exterior radius of a commonly, commercially available finger ring that is to be immobilized.

The gripping section 12 is formed by a plate-like element of an even thickness $d_G$ of ca. 5 mm. In the upper area of the gripping section 12, two side arm 18*a*, 18*b* are configured as fixation elements and protrude laterally relative to the gripping section 12. The respectively bottommost points of the side arms 18*a*, 18*b* are stop elements 20*a*, 20*b* at the same time. The previously described design allows for letting the ring holder 10 slide into the openings, which are configured as slots 38 with a slot width of less than 5 mm, by utilizing gravitational force (the direction of the gravitational acceleration is indicated by the arrow g). In the shown embodiment, the angle between the longitudinal axis of the ring holder 10 and the normal is ca. 20°.

The stop elements 20*a*, 20*b* that are configured on the side arms 18*a*, 18*b* then jointly constitute a stop that prevents a ring holder 10, which was pushed over the length of the total plunging area, to plunge any further into the slot 38 of the ring display 36.

It is understood that ring holders according to the first embodiment can also be used in conjunction with the ring display as depicted in FIG. 3. If so, the slot width should be matched to the thickness $d_G$ of the gripping section.

LIST OF REFERENCE SIGNS

10 Ring holder
12 Gripping section
14 Contact surface
18 Side arm
20 Stop element
22 Center axis
23 Plunge area
24 Through-hole
26 Depression
28 Construction
30 Ring
32 Holding means/holding element
34 Holding area
36 Ring display
38 Slot
40 Application

The invention claimed is:

1. A ring holder (10) comprising:
a flat gripping section (12);
at least one curved contact surface (14) arranged in a transverse direction relative to the gripping section (12) and adjoining the gripping section (12) for disposing the outer side of a ring as an extension of the gripping section (12);
a central through-hole (24) in the gripping section (12); and
at least two side arms (18) located to a right side and a left side of the gripping section;
wherein the central through-hole (24) and the at least two side arms (18) are spaced at a distance relative to each other in the transverse direction, and allow for immobilizing a ring relative to the contact surface (14) when a strip-like holding means is used.

2. The ring holder according to claim 1, characterized in that a depression (26) is provided at least on one of the side arms (18) for accommodating a holding means (32).

3. The ring holder according to claim 1, characterized in that the at least two side arms (18) each have a width of 10% to 50% of the width of the gripping section.

4. The ring holder according to claim 1, characterized in that the gripping section (12) has a plunging area (23) of even thickness on the side that is opposite relative to the contact surface (14), and the plunging area borders at least partially on a flat stop element (20).

5. The ring holder according to claim 4, characterized in that the stop element (20) is formed on at least one of the at least two side arms (18).

6. The ring holder according to claim 1, characterized in that the contact surface (14) is constituted at least in part of a lateral surface of one or more of the at least two side arms (18).

7. The ring holder according to claim 1, characterized in that the ring holder (10) is configured in one piece.

8. The ring holder according to claim 1, having a total of four side arms, two side arms being located to the right side of the gripping section, and two side arms being located to the left side of the gripping section.

9. The ring holder according to claim 1, wherein the gripping section and the at least two side arms have a T-shaped cross-section in a longitudinal sectional plane of the ring holder.

10. A method for connecting a ring to a ring holder (10) that comprises:
a flat gripping section (12);
at least one contact surface (14) arranged in a transverse direction relative to the gripping section (12) and adjoining the gripping section (12) for disposing the outer side of a ring as an extension of the gripping section (12);
a central through-hole (24) in the gripping section (12); and
at least two side arms (18) located to a right side and a left side of the gripping section;
wherein the central through-hole (24) and the at least two side arms (18) are spaced at a distance relative to each other in the transverse direction, and allow for immobilizing a ring relative to the contact surface (14) when a strip-like holding means is used;
characterized by the following method steps:
a) Positioning the ring on the contact surface (14);
b) Fixing the position of the ring on the contact surface (14) of the ring holder (10) with at least one strip-like holding element (32*a*) relative to the at least two side arms (18) of the contact surface (14), such that the holding element (32*a*) causes a reset force to be generated relative to the fixed position, when relative movements occur;
c) Optionally additionally fixing the ring with a holding element (32*b*) that passes through the through-hole (24).

11. A ring holder (10) comprising:
a flat gripping section (12);
at least one contact surface (14) arranged in a transverse direction relative to the gripping section (12) and adjoining the gripping section (12) for disposing the outer side of a ring as an extension of the gripping section (12);
a central through-hole (24) in the gripping section (12);
a constriction (28) provided in an area above the central through-hole (24); and at least two side arms (18) located to a right side and a left side of the gripping section;

wherein the central through-hole (24) and the at least two side arms (18) are spaced at a distance relative to each other in the transverse direction, and allow for immobilizing a ring relative to the contact surface (14) when a strip-like holding means is used.

12. A ring holder (10) comprising:

a flat gripping section (12);

at least one contact surface (14) arranged in a transverse direction relative to the gripping section (12) and adjoining the gripping section (12) for disposing the outer side of a ring as an extension of the gripping section (12);

a central through-hole (24) in the gripping section (12);

at least two side arms (18) located to a right side and a left side of the gripping section; and a strip-like holding means for immobilizing a ring relative to the contact surface (14), wherein the central through-hole (24) and the at least two side arms (18) are spaced at a distance relative to each other in the transverse direction, and allow for immobilizing the ring relative to the contact surface (14) when the strip-like holding means is used.

* * * * *